US011118868B2

(12) United States Patent
Banes et al.

(10) Patent No.: US 11,118,868 B2
(45) Date of Patent: Sep. 14, 2021

(54) LEVELING RAIL DEVICE

(71) Applicant: Sellmark Corporation, Mansfield, TX (US)

(72) Inventors: Matthew Banes, Sachse, TX (US); Garret Hellinger, Sachse, TX (US); Gabriel Snyder, Sachse, TX (US)

(73) Assignee: Sellmark Corporation, Mansfield, TX (US)

( * ) Notice: Subject to any disclaimer, the term of this patent is extended or adjusted under 35 U.S.C. 154(b) by 0 days.

(21) Appl. No.: 16/424,692

(22) Filed: May 29, 2019

(65) Prior Publication Data

US 2019/0368840 A1 Dec. 5, 2019

Related U.S. Application Data

(60) Provisional application No. 62/679,366, filed on Jun. 1, 2018.

(51) Int. Cl.

| | |
|---|---|
| ***F41A 23/10*** | (2006.01) |
| ***F41G 11/00*** | (2006.01) |
| ***F41A 23/12*** | (2006.01) |

(52) U.S. Cl.

CPC ..... *F41G 11/003* (2013.01); *F41A 23/12* (2013.01)

(58) Field of Classification Search

CPC ..... F41G 11/003; F41G 11/00; F41G 1/35; F41A 23/12; F41A 23/14; F41C 23/16; F41C 27/00

USPC ..... 42/90, 94, 124–128; 73/167

See application file for complete search history.

(56) References Cited

U.S. PATENT DOCUMENTS

| | | | | |
|---|---|---|---|---|
| 4,212,109 | A * | 7/1980 | Snyder | F41G 11/002 42/115 |
| 6,877,266 | B1 * | 4/2005 | Brownlee | F41A 23/16 42/90 |
| 7,421,815 | B1 * | 9/2008 | Moody | F41C 23/16 248/171 |
| 7,665,239 | B1 * | 2/2010 | Moody | F41A 23/08 42/72 |
| 7,676,977 | B1 * | 3/2010 | Cahill | F16M 11/16 248/168 |
| D772,372 | S * | 11/2016 | Hellinger | D22/199 |
| 10,012,465 | B1 * | 7/2018 | Liechty | F41A 23/10 |
| 10,161,706 | B2 * | 12/2018 | Roberts | F41A 23/10 |
| 10,161,707 | B2 * | 12/2018 | Scott | F41A 23/06 |
| 10,168,119 | B2 * | 1/2019 | Roberts | F41A 23/10 |
| 10,254,069 | B2 * | 4/2019 | Palu | F41A 23/10 |
| 10,295,292 | B2 * | 5/2019 | Ding | F41A 23/02 |
| 10,393,466 | B1 * | 8/2019 | Lavender | G09B 19/003 |
| 10,408,555 | B2 * | 9/2019 | Flood, Jr. | F41A 23/10 |
| 10,415,920 | B2 * | 9/2019 | Haskell | F41A 23/10 |
| D875,871 | S * | 2/2020 | Roberts | D22/108 |

(Continued)

*Primary Examiner* — Michael D David

(74) *Attorney, Agent, or Firm* — Scott L. Harper; Mark D. Perdue

(57) ABSTRACT

The present disclosure relates to a leveling rail apparatus configured for directly mounting a rifle onto a tripod, a pan-tilt head mount, or other support structure, as disclosed herein. The apparatus may comprise, by way of example, a rail mount for securing the firearm; a leveling structure coupled to the rail mount and having at least one arcuate surface, the leveling structure operable to swivel about the arcuate surface; and a securing means coupled to the leveling structure, the securing means for securing the leveling structure to the rail mount.

14 Claims, 2 Drawing Sheets

(56) References Cited

U.S. PATENT DOCUMENTS

| | | | | |
|---|---|---|---|---|
| 2008/0134555 | A1* | 6/2008 | Werner | F41A 23/16 42/69.01 |
| 2008/0276518 | A1* | 11/2008 | Moody | F41A 23/08 42/72 |
| 2008/0295379 | A1* | 12/2008 | Potterfield | F41A 23/10 42/94 |
| 2010/0307043 | A1* | 12/2010 | Moody | F41A 23/08 42/72 |
| 2011/0126444 | A1* | 6/2011 | Keng | F41A 23/10 42/94 |
| 2012/0144717 | A1* | 6/2012 | Peterson | F41G 11/003 42/94 |
| 2014/0123532 | A1* | 5/2014 | Russ | F41G 1/38 42/113 |
| 2014/0237882 | A1* | 8/2014 | Banes | F41A 23/02 42/94 |
| 2016/0209172 | A1* | 7/2016 | Trotabas | F41G 1/44 |
| 2016/0273865 | A1* | 9/2016 | Banes | F16M 13/02 |
| 2017/0167817 | A1* | 6/2017 | Hayes | F41A 23/10 |
| 2018/0073839 | A1* | 3/2018 | Crispin | F41G 11/001 |
| 2018/0320819 | A1* | 11/2018 | Banes | F16M 13/04 |
| 2019/0226806 | A1* | 7/2019 | Noller | F41G 1/387 |

* cited by examiner

LEVELING RAIL DEVICE

CROSS-REFERENCE TO RELATED APPLICATIONS

This application claims the benefit of, and priority to, U.S. Provisional Patent Application Ser. No. 62/679,366, filed on Jun. 1, 2018 and entitled "Leveling Rail Device", the content of which is incorporated herein by reference for all purposes.

The present disclosure relates to a leveling rail apparatus for the direct mounting of a rifle onto a support structure such as tripod, pan-tilt head mount, or other mount.

BACKGROUND

Conventional mounting systems for securing a rifle onto a tripod platform may include a pan-tilt head mount. A pan-tilt head mount is generally only capable of rotation about two perpendicular axes. As a result, a user may experience a reduced range of flexibility, as well as a limited or reduced ability to adjust and level the system to account for rifle canting, thereby resulting in missed shots.

SUMMARY

The present disclosure relates to a leveling rail apparatus configured for directly mounting a rifle onto a tripod, a pan-tilt head mount, or other support structure, as disclosed herein.

According to an embodiment, the apparatus may comprise a rail mount for securing the firearm; a leveling structure coupled to the rail mount and having at least one arcuate surface, the leveling structure operable to swivel about the arcuate surface; and a securing means coupled to the leveling structure, the securing means for securing the leveling structure to the rail mount.

The details of one or more implementations are set forth in the accompanying drawing and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawing, in which.

DETAILED DESCRIPTION

Long-range rifle shooting typically requires the use of a support structure to hold and steady the rifle. Because shooters may desire to fire on uneven terrain, from varying positions, or from various locations, tripods are commonly used to steady long-range rifles. A tripod shooting platform allows for versatility with its adjustable height, its independently extendable legs to accommodate uneven surfaces, and its lightweight and transportable structure.

In order to mount and secure a rifle onto a tripod platform, various mounting attachments are conventionally used. Among the most common mounting attachments are ballhead mounts and pan-tilt head mounts.

A ballhead mount uses a ball-and-socket type joint for orientation control. The ball sits in a socket, which may be tightened by a knob or other component to lock the ball in place. The ball may move multi-directionally in various tilts and angles and along various planes. Such multi-directional movement capability may allow for rifle canting, i.e., the leaning or tilting of a rifle to the left or the right side to account for uneven shooting positions. However, the multidirectional/multiplane capability of the ballhead mount may also result in reduced stability and/or leveling capability when the ball is switched to an unlocked position. For example, when a user unlocks the ball, the mounted rifle may suddenly move in any direction, making it difficult to carry out precise or intricate adjustments of the rifle's position.

A pan-tilt head mount allows for rotation about two perpendicular axes, typically vertical and horizontal axes. As such, the pan-tilt head may operate by controlling two hinges: one hinge adjusting a horizontal angle of the rifle and allowing for rotation in a horizontal plane (i.e., pan); and one hinge adjusting a vertical angle of the rifle and allowing for rotation in a vertical plane (i.e., tilt). Unlike the ballhead mount, the pan-tilt head mount allows for more precision control of the rifle's position by directional adjustment because a rifle secured in a pan-tilt head mount is unlikely to slip into uncontrolled positions when unlocked. However, disadvantages of the pan-tilt head mount include its inability to operate beyond two axes, adjust for rifle canting, and account for uneven shooting positions. Thus, there is a need for a device that may be coupled to a pan-tilt head mount that allows for increased flexibility and rifle canting adjustments, while maintaining precision control of the rifle's position.

Embodiments of the present disclosure generally provide a leveling rail for the direct mounting of a rifle onto a tripod, a pan-tilt head mount, or other support structure. The leveling rail may comprise a plurality of different features and components as described herein.

Figure 1:
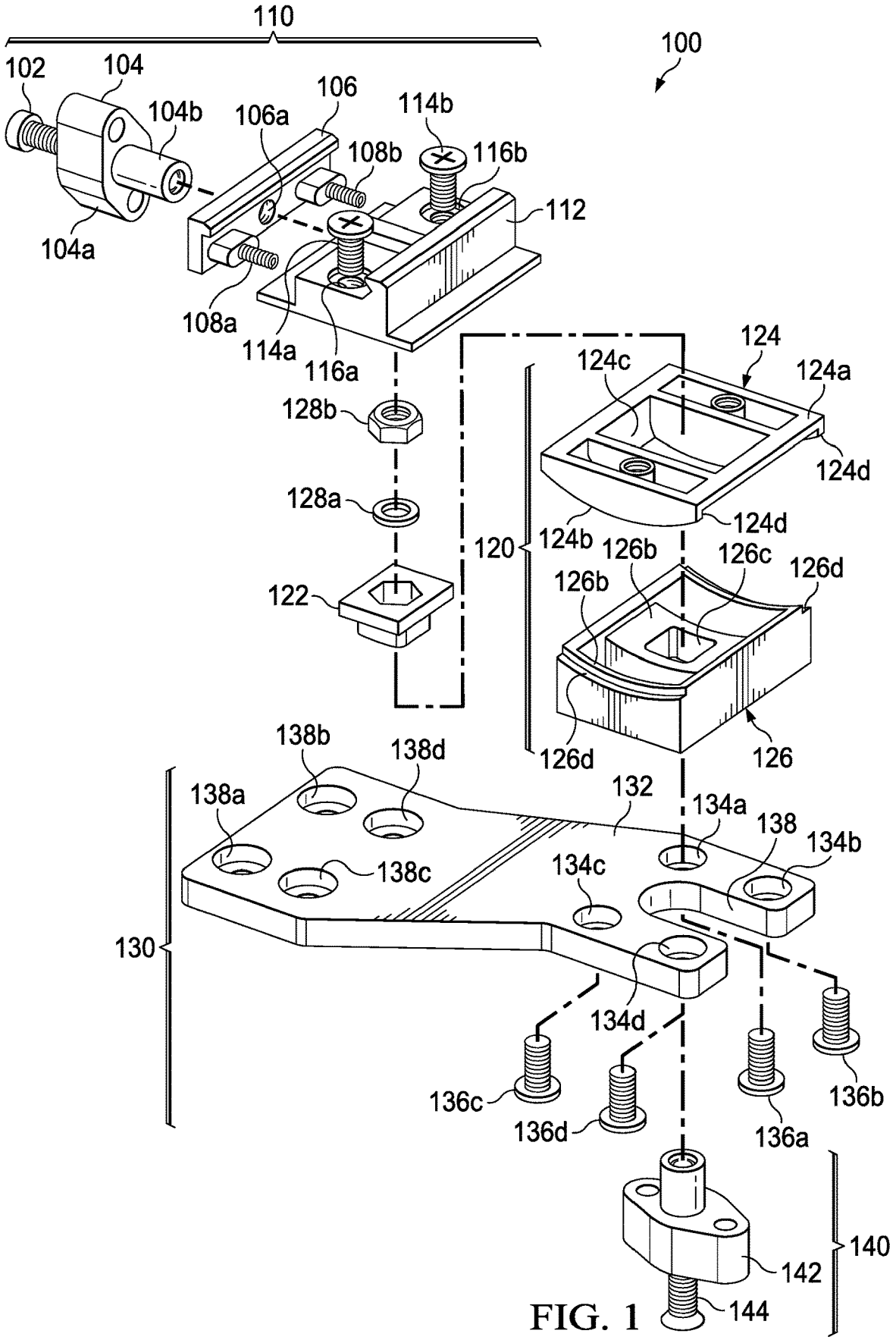
FIG. 1 illustrates an exploded view of a leveling rail according to the present disclosure.

FIG. 1 depicts an exploded view of a leveling rail 100 according to the present disclosure. The leveling rail 100 may generally comprise a rail mount 110, a leveling structure 120, a base structure 130, and a securing means 140, along with various connectors, attachments, and elements as shown in FIG. 1.

The rail mount 110 of the leveling rail 100 may function as an attachment interface onto which a rifle may be mounted. The rail mount 110 may comprise any rail mount or other direct-style mounts known in the art, including but not limited to pan-tilt head mounts, such as Picatinny, Arca Swiss, Dovetail, Warsaw Pact, Weaver, M-Lok, KeyMod, among other rail mounting devices. Rail mount 110 may generally comprise, among other things, a bolt 102, a knob 104, a lateral member 106, body springs 108*a* and 108*b*, and a body 112.

Knob 104 may comprise a handle 104*a* with an arm 104*b* extending therefrom. Bolt 102 may be threaded through the handle 104*a* and the arm 104*b*. Knob 104 may be joined to the lateral member 106 via the bolt 102 which may be threaded through the arm 104*b* of the knob 104 through a hole 106*a* in the lateral member 106.

Figure 2:
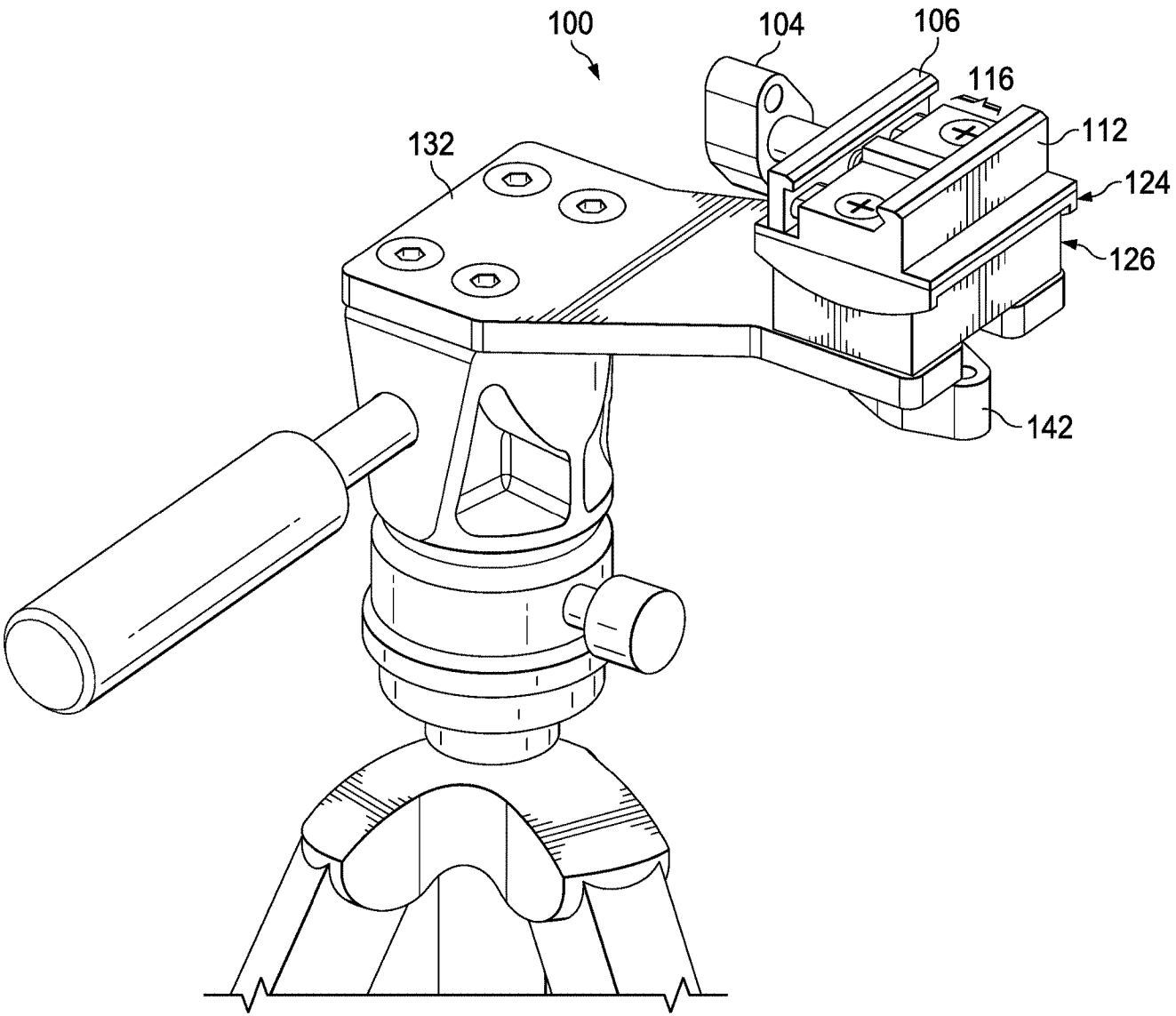
FIG. 2 illustrates a perspective view of a leveling rail according to the present disclosure.

With reference now to FIG. 2 in connection with FIG. 1, the lateral member 106 and the body 112 may be slidably drawn together to form a slot 116 into which a rifle with corresponding rail mount hardware may be received and secured to rail mount 110 as is known in the art. For example, a Picatinny rail mount would require a corresponding Picatinny rail affixed to the firearm. The firearm, via the attached rail, may then be inserted into slot 116 of rail mount 110. As shown in FIG. 1, the lateral member 106 and the body 112 may be slidably drawn towards or separated from each other by the rotation of the knob 104 connected to the lateral member 106. For example, rotation of the knob 104 in a first direction (a tightening direction) may operate to slide and adjust the lateral member 106 toward the body 112, to secure a firearm to rail mount 110. Similarly, rotation of the knob 104 in a second direction (a loosening direction) may operate to adjust and slide the lateral member 106 away from the body 112, thereby allowing the removal of a firearm from rail mount 110. Body springs 108*a* and 108*b* may be disposed on an inside surface of the lateral member 106 and may facilitate the separation of the lateral member 106 away from the body 112 when the knob 104 is loosened. The rail mount 110 may further comprise rail screws 114*a*, 114*b* disposed in threaded holes 116*a*, 116*b* for coupling the rail mount 110 to the leveling structure 120. The rail mount 110 may further include any number of other components and/or attachments known in the art.

With continued reference to FIG. 1, the leveling structure 120 of the leveling rail 100 may comprise a top piece or portion 124 and a base piece or portion 126. Top piece 124 and bottom base piece are configured and connected together to permit rotation between them along a longitudinal axis, as described below. The top piece 124 of the leveling structure 120 may comprise a top surface 124 and a bottom surface 124 *b*. The top surface 124 may comprise a flat planar surface, configured to be the substantially the same shape as the bottom surface of the body 112 of the rail mount 110 to thereby facilitate the joining of the leveling structure 120 with the rail mount 110. The top surface 124 *a* may further be configured with a depression 124 *c* at its center to receive a connector 122 (described below). The bottom surface 124 *b* of the top piece 124 may comprise an arcuate or cylindrical surface to facilitate a swiveling or pivoting movement of the top piece 124. According to an embodiment, the bottom surface 124 *b* of the top piece 124 may comprise a convex surface. The top piece 124 may also include lips 124 *d* disposed on opposing ends of the bottom surface 124 *b*. The lips 124 *b* may be configured to mateably attach the top piece 124 to the base piece 126, as further described below.

The base piece 126 of the leveling structure 120 may comprise an arcuate or cylindrical upper or top surface 126 *b* which may be configured to interface and mateably join with the bottom surface 124 *b* of the top piece 124. According to an embodiment, the arcuate top surface 126 *b* may comprise a concave cylindrical mating surface to mateably join with a convex bottom surface 124 *b* of the top piece 124. The base piece 126 may further comprise notches or recesses, or grooves 126 *d* located on opposing sides of the arcuate top surface 126 *b*. Notches 126 *d* may interface with lips 124 *d* disposed on the bottom surface 124 *b* of the top piece 124 (thereby allowing for the joining of the top piece 124 with the base piece 126, as well as the swiveling of the bottom surface 124 *b* of the top piece 124 along the top surface 126 *b* of the base piece 126). Base piece 126 may further comprise a recessed area or cutout 126 *c* disposed within its perimeter to capture any dust and/or debris that may enter and lodge therein. The manual removal of such captured dust and/or debris may ensure the smooth swiveling or pivoting of the top piece 124 along the top surface 126 *b* of the base piece 126.

With continued reference to FIG. 1, the base piece 126 of the leveling structure 120 may be assembled atop a base structure 130. Base structure 130 may comprise a base plate 132 having holes 134 *a*, 134 *b*, 134 *c*, and 134 *d* configured to receive screws 136 *a*, 136 *b*, 136 *c*, and 136 *d*. Screws 136 *a*, 136 *b*, 136 *c*, and 136 *d* may be threaded from the underside of base plate 132 to connect the base plate 132 to base piece 126. Base plate 132 may be interchangeable with various different platforms and is not required to be formed to any particular shape or size. Base plate 132 may further comprise a groove 138 into which securing means 140 may be affixed. Base plate 132 may further include a fixture for securing base plate 132 to a support structure and may comprise holes 138 *a*, 138 *b*, 138 *c*, and 138 *d* for attachment of base structure 130 to a support structure (not shown), such as a tripod, a pan-tilt head mount, or the like.

Securing means or tension adjuster 140 may comprise an adjustable fastener in the form of a tension adjustment knob 142 and bolt 144. The bolt 144 may facilitate assembly of the rail mount 110, the leveling structure 120, the base structure 130, and the tension adjustment knob 142 of leveling rail 100. Bolt 144 may be threaded first through the tension adjustment knob 142, then through groove 138 of base plate 132, then through cutout 126 *c* of base piece 126, then through depression 124 *c* of top piece 124, through a connector 122, a washer 128 *a*, and a nut 128 *b* (which together may provide the drag adjustment needed for the leveling rail 100), and into body 112 of rain mount 110. Tension adjustment knob 140 may be utilized to adjust the tightness of leveling rail 100 by selectively altering, increasing or decreasing, pressure and friction or frictional engagement between cylindrical surfaces 124 *b* and 126 *b* to allow for movement along a spectrum of rigidity, ranging from substantially frictionless rotation of the leveling rail 100 to a substantial fixation of the leveling rail 100, wherein movement base piece 126 and top piece 124 are secured against rotation relative to one another.

With continued reference to FIGS. 1 and 2, in one operative embodiment, the leveling rail 100 may first be assembled onto a pan-tilt mount or other such mount. A firearm may be affixed with a rail which mateably corresponds to the specific rail mount 110 to be used with leveling rail 100. For example, a Picatinny rail mount would require a corresponding Picatinny rail affixed to the firearm. The firearm, via the attached rail, may then be inserted into slot 116 of rail mount 110. Knob 104 may be used to adjust the tightness of the rail mount 110 against the corresponding rail affixed to the firearm. The user may then adjust the position of the firearm to the left or to the right, as the leveling structure 120 may swivel or pivot to the left or to the right along the arcuate bottom surface 124*b* of the top piece 124. The user may adjust the tension of the leveling structure 120 by adjusting tension adjustment knob 142.

It is to be understood that various modifications may be made to the leveling rail 100 without departing from the scope of the present disclosure. For example, although the leveling structure 120 is described above as a two-piece structure, it may alternatively comprise a single-piece or multi-piece structure. Moreover, while the top piece 124 and the bottom piece 126 of the leveling structure 120 are described as arcuate (and depicted in the figures as convex and concave, respectively), it is to be understood that these pieces may be fashioned in any manner, whether arcuate or otherwise, that allows for a swiveling or pivoting action.

It is further to be understood that the leveling rail 100 disclosed herein may be modified for coupling directly to a tripod, other pan tilt platforms, and/or other support structures known in the art. By utilizing leveling rail 100 on a pan tilt platform, the user will be able to enjoy the benefits of a ballhead mount without compromising precision and stability when unlocked.

It is also to be understood that the implementations are not limited to particular apparatus or methods described which may, of course, vary. For example, the leveling rail 100 need not be limited to the specific design or parts disclosed herein. Moreover, the invention defined by the above paragraphs is not to be limited to particular details set forth in the above description, as many apparent variations thereof are possible without departing from the spirit or scope of the present disclosure. It is also to be understood that the terminology used herein is for the purpose of describing particular implementations only and is not intended to be limiting.

The invention claimed is:

1. An apparatus for mounting a firearm onto a support structure, the apparatus comprising:

a base including a fixture for securing the base to the support structure;

a rail mount for securing a firearm; and a leveling structure coupling the rail mount to the base and including:

a top portion having a generally planar upper surface, and a generally cylindrical lower surface having a longitudinal axis, the top portion supporting the rail mount on its generally planar upper surface; and a base portion with a generally cylindrical upper surface, the base portion supported on the base at its lower extent; and an adjustable fastener extending through the cylindrical upper and lower surfaces and coupling the top and base portions of the leveling structure together with the cylindrical upper and lower surfaces in mating relation, wherein the top portion rotates relative to the base portion about the longitudinal axis and the adjustable fastener selectively alters frictional engagement between the cylindrical upper and lower surfaces.

2. The apparatus of claim 1 further comprising:

a lip projecting beyond the upper cylindrical surface of the top portion; and a groove formed in the lower cylindrical surface of the base portion, wherein, upon mating together of the upper and lower cylindrical surfaces, the lip is received in the groove.

3. The apparatus of claim 1, wherein the upper cylindrical surface is convex and the lower cylindrical surface is concave.

4. The apparatus of claim 1, wherein the adjustable fastener is a threaded bolt secured to the top portion of the leveling structure and extending through the base portion of the leveling structure and the base.

5. The apparatus of claim 4, wherein the adjustable fastener includes a tension-adjustment knob threaded onto the threaded bolt, wherein rotation of the tension-adjustment knob selectively secures the top portion of the leveling structure against rotation relative to the base portion.

6. The apparatus of claim 1, wherein the fixture on the base comprises at least one aperture for receiving a fastener to secure the base to the support structure.

7. The apparatus of claim 1, further comprising a recessed cut out formed in the cylindrical upper surface of the base portion.

8. An apparatus for mounting a firearm onto a support structure, the apparatus comprising:

a base plate configured to be secured to the support structure, the base plate having an upper surface;

a leveling structure base portion secured at its lower end to the upper surface of the base plate, the leveling structure base having a generally cylindrical upper surface;

a leveling structure top portion having a generally planar upper surface and a generally cylindrical lower surface having a longitudinal axis;

a rail mount for securing the firearm secured to the generally planar upper surface of the leveling structure top surface; and an adjustable fastener extending through the upper and lower cylindrical surfaces and coupling the leveling structure top and base portions together with the upper and lower cylindrical surfaces in mating relation, wherein the top portion rotates relative to the base portion about the longitudinal axis and the adjustable fastener selectively alters frictional engagement between the upper and lower cylindrical surfaces the top and base portions against rotation relative to one another.

9. The apparatus of claim 8, further comprising:

a lip projecting beyond the upper cylindrical surface of the top portion; and a groove formed in the lower cylindrical surface of the base portion, wherein, upon mating together of the upper and lower cylindrical surfaces, the lip is received in the groove.

10. The apparatus of claim 8, wherein the upper cylindrical surface is convex and the lower cylindrical surface is concave.

11. The apparatus of claim 8, wherein the adjustable fastener is a threaded bolt secured to the top portion and extending through the base portion.

12. The apparatus of claim 11, wherein the adjustable fastener includes a tension-adjustment knob threaded onto the threaded bolt, wherein rotation of the tension-adjustment knob selectively secures the top portion against rotation relative to the base portion.

13. The apparatus of claim 8, further comprising:

at least one aperture formed in the base plate for receiving a fastener to secure the base to the support structure.

14. The apparatus of claim 8, further comprising a recessed cut out formed in the cylindrical upper surface of the base portion.

* * * * *